US005511351A

United States Patent [19]

Moore

[11] Patent Number: 5,511,351

[45] Date of Patent: Apr. 30, 1996

[54] DRAINAGE SYSTEM FOR DECKS

[76] Inventor: Grant M. Moore, 3599 Aaron Sosebee Rd., Cumming, Ga. 30130

[21] Appl. No.: 129,428

[22] Filed: Sep. 29, 1993

[51] Int. Cl.[6] ..... E04B 1/70

[52] U.S. Cl. ..... 52/302.1; 52/11; 405/119

[58] Field of Search ..... 52/302.1, 302.3, 52/302.5, 462, 13, 11, 478, 396.04; 405/119

[56] References Cited

U.S. PATENT DOCUMENTS

| | | | |
|---|---|---|---|
| 4,065,883 | 1/1978 | Thibodeau | 52/11 |
| 4,663,894 | 5/1987 | LaRoche et al. | 52/15 |
| 4,860,502 | 8/1989 | Michelsen | 52/11 |

*Primary Examiner*—Creighton Smith
*Attorney, Agent, or Firm*—Hopkins & Thomas

[57] ABSTRACT

A drainage system for a conventional deck assembly made of flexible material and mounted beneath the surface decking between adjacent deck joists. The drainage system is designed to collect water leaking through the spaces between adjacent deck cross pieces and channel it to a gutter and downspout, keeping the area beneath the deck dry. The deck drainage system consists of a plurality of water channeling members respectively formed from substantially flexible web material mounted side-by-side in succession and mounted in an overlapping relationship, straddling adjacent deck joists thereby removing the deck joists from view.

14 Claims, 4 Drawing Sheets

10
12
14
14d
14e
14g
16
17
18
19
20
21
22
26a
26b
28
29
34
40
60
61
62
63
64
65
66

DRAINAGE SYSTEM FOR DECKS

FIELD OF THE INVENTION

This invention relates to a deck assembly and is more particularly concerned with a drainage system for decks and a method of installing the same.

BACKGROUND OF THE INVENTION

The conventional deck construction such as a raised deckprovides opened cracks between the cross pieces comprising the deck surface so that water will drain through the cracks and not collect on the deck surface. However, the area below the deck, which may be used as a second patio or storage area is exposed to the elements of nature, particularly rain which passes through the openings or cracks in the deck.

A deck drainage system that collects and channels water running through the cracks in a deck floor is disclosed in U.S. Pat. No. 4,065,883 to Thibodeau. Thibodeau utilizes a plurality of prefabricated gutters designed to be installed while the deck is under construction. Each gutter is fabricated with a base that slopes downwardly from one end to the other to facilitate the flow of water. The gutters rest between and on the deck joists, supported by flanges extending outwardly from the upstanding side members. However, the gutters must be manufactured at one site and then transported to the installation site. Once installed, Thibodeau's drainage system may not be removed without extensive destruction of the deck.

U.S. Pat. No. 4,860,502 to Mickelsen discloses a drainage system for decks that may be installed on existing decks. Mickelsen utilizes gutter hangers fastened at an incline to the interior surface of two adjacent deck joists. A gutter panel is then coupled between the two gutter hangers. As in Thibodeau, Mickelsen requires the gutter hangers and panels to be custom fabricated at one site and then transported to the installation site. Additionally, the deck joists remain visible in both designs.

BRIEF DESCRIPTION OF THE INVENTION

Briefly described, the present invention includes a conventional deck assembly having equally spaced longitudinally extending floor boards or cross pieces supported by spaced traverse deck joists and a deck drainage system made of flexible and light weight web material, which can be installed easily and inexpensively. In more detail, the deck drainage system of the present invention includes a plurality of water channeling members mounted in an overlapping relationship, straddling adjacent deck joists for directing collected water to a gutter and thence to a downspout.

The water channeling members are generally rectangular sheets, substantially uniform in width and length, made of any flexible and light weight web material that is waterproof, such as fire retardant sheets of plastic. The sheets, manufactured in standard widths, can be stored on a reel and later cut to the appropriate dimensions at the installation site. The water channeling members are installed by mounting the flexible sheets between two adjacent joists with fastening members such as T-50 staples and/or nails. The water channeling members are selectively mourned below the flooring to the deck joists in either of two different configurations. In one embodiment, the water channeling members are mounted to the vertical side surfaces of the deck joists at an incline with respect to the deck joists and forming successively U-shaped scallops defining the water channeling members to facilitate water flow away from the structure. In another embodiment, the water channeling members are mounted to the bottom surfaces of the deck joists where the decks are built at an incline in accordance with local building codes.

A gutter is installed transversely across the discharge ends of the water channeling members to collect water from the channeling members and direct it to a downspout where it is discharged by gravity in the normal fashion, thus, controlling erosion to the surface below. If desired, an inner gutter is disposed transversely below the proximate ends of the deck joists, the inner gutter being mounted to the bottom surface of the house header. The inner gutter is used to collect water which may drain through the space between the inner or proximate ends of the water channeling members and the house header and discharge this water at one or both ends of the inner gutter.

The deck drainage system of the present invention may be easily installed on decks under construction or on those decks already in existence.

Once installed, the drainage system creates a contemporary look, covering the unsightly joists. Additionally, the water channeling members may be produced in a variety of colors or painted, according to one's personal taste. Trim molding may be mounted to cover the exposed fasteners or to cover seams created by the water channeling members overlapping the deck joists.

Accordingly, it is an object of the present invention to provide a drainage system for decks which will provide effective protection from rain to items stored below the deck.

Another object of the present invention is to provide a drainage system for decks which is inexpensive to manufacture and install, durable in structure and efficient in operation.

Another object of the present invention is to provide a drainage system for decks which is contemporary in appearance and aesthetically valuable.

Another object of the present invention is to provide a drainage system for decks which covers the unsightly deck joists from view.

Another object of the present invention is to provide a drainage system for decks which involves fewer parts and is installed in less time.

Another object of the present invention is to provide a drainage system for decks that can be easily maintained and repaired.

Another object of the present invention is to provide a drainage system for decks that can be installed on a conventional deck regardless of whether or not the deck has cross bracing.

Another object of the present invention is to provide a drainage system for decks which will prevent or appreciably reduce erosion to the surface below the deck.

Another object of the present invention is to provide a drainage system for decks which can be easily removed without damage to the deck, or itself.

Other objects, features and advantages of the present invention will become apparent from the following detailed description when considered in conjunction with the accompanied drawings, wherein like characters of reference designate corresponding pans throughout the several views.

DETAILED DESCRIPTION OF THE PREFERRED EMBODIMENT

Figure 1:
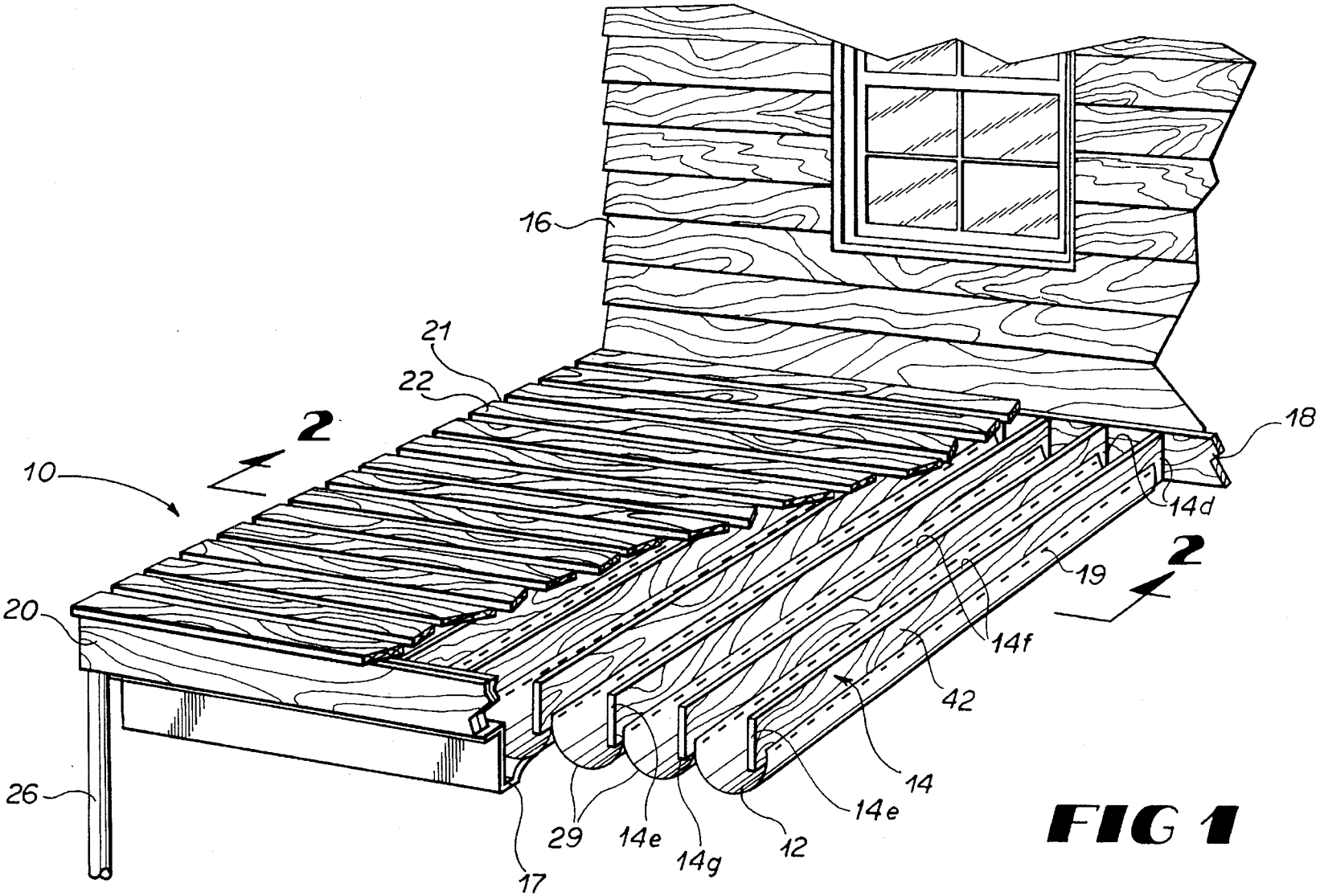
FIG. 1 is a fragmentary perspective view of a conventional deck structure attached to a house and having a drainage system constructed in accordance with the present invention incorporated therewith.

Referring now in detail to the embodiments chosen for the purpose of illustrating the present invention, FIG. 1 depicts a residential or commercial structure 16 having a generally horizontally extending conventional raised deck 10. The raised deck 10 is fixed to the structure 16 by means of a horizontal house header 18 which is disposed flat against and is fixed to the exterior wall of the structure 16. The house header 18 comprises one side of the generally rectangular support frame of the raised deck 10. The support frame generally consist of four beams secured together at their distal ends in a generally rectangular configuration. A beam 20 of the support frame is disposed parallel to and opposite the house header 18 and is supported by two upright posts 26. Disposed inside the support frame are a plurality of equally spaced, paralled, elongated, rectangular, deck joists 14, running longitudinally in a direction generally perpendicular to the house header 18 with their peripheral ends 14*d* abutting header 18 and their distal ends joined by the beam 20. Each joist 14 is thus provided with opposed parallel side surfaces 40 and 42, an upper surface 14*f*, and a lower or bottom surface 14*g*.

Transversely disposed across the top or upper surface 14*g* of the deck joists 14 are a plurality of cross pieces or plates 22 positioned on their sides parallel to one another. The cross pieces 22 are spaced an equal distance apart to provide small parallel cracks, openings or spaces between the side edges of adjacent cross pieces for water to pass through by gravity. Such cracks, openings or spaces 21 are transverse to the deck joists 14.

In accordance with the present invention, a plurality of individual flexible water channeling members 12 are disposed in an overlapping relationship, straddling adjacent deck joists 14 in successive fashion. The water channeling members 12 are substantially rectangular in shape and uniform in thickness throughout. The preferred material for construction of the water channeling members 12 is flame retardant plastic such as PVC. The water channeling members 12 are of a length substantially the same as the deck joists 14, and a width equal to or greater than the distance between the center line of two adjacent deck joists 14. The water channeling members 12 are suspended successively between adjacent deck joists 14 so as to form troughs which collect water passing between adjacent cross pieces 22. The water collected by the water channeling members 12 is directed away from the structure 16 into a gutter 17 disposed adjacent to the distal ends 29 of all said water channeling members 12, preventing the area below the raised deck 10 from getting wet. Water that drains between the water proximal ends 28 of channeling members 12 and the structure 16 is collected by an inner gutter 60 and discharged out one or both ends of the inner gutter 60.

The preferred embodiment of the inner gutter 60 is a Z-shaped member having a mounting flange 61 connected to the gutter bottom 63 by a connecting flange 62. Extending from the gutter bottom 63 is a reverse flange 64 to contain water collected, thus conducting water out one or both ends of the inner gutter so that it is dry below the raised deck 10.

The flexible web material of a prescribed width, from which the water channeling members 12 are formed may be supplied to the site in a reel (not shown) and cut transversely to length on the site.

Figure 2:
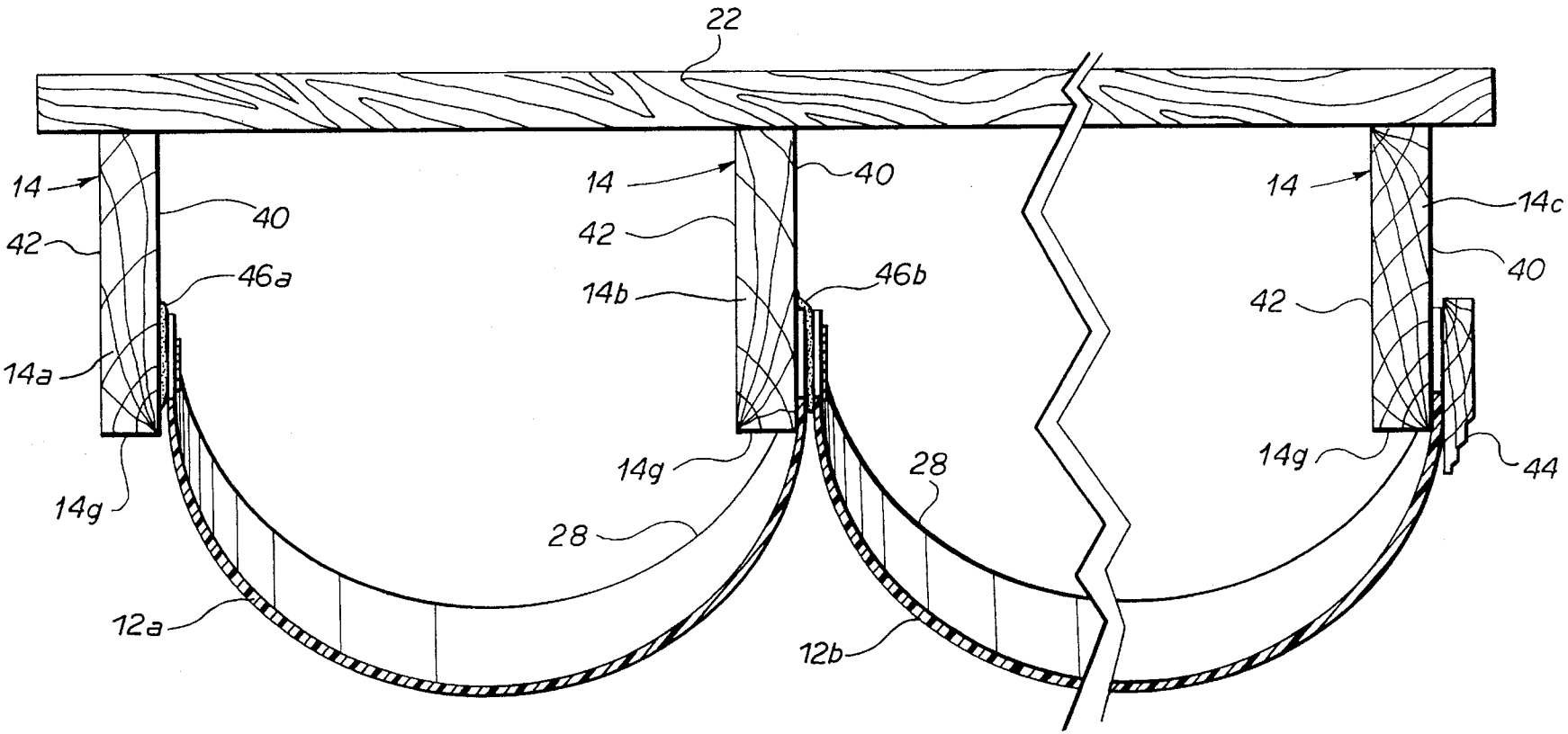
FIG. 2 is an enlarged fragmentary vertical sectional view taken substantially along line 2—2 in FIG. 1.

In the first embodiment, shown in FIGS. 1 through 3*d*, a scalloped configuration of the water channeling members 12 is produced by cutting the web material to length and mounting them to the successive vertical side surfaces 40 and 42 of successive deck joists 14. Installation of the scalloped configuration should begin at an outermost joist 14*a* in FIG. 3 of the raised deck 10 and continues thereacross. As illustrated in FIG. 2, the first channeling member 12*a* is installed to the first deck joist 14*a*by securing one edge portion of water channeling member 12*a* to the inside vertical side surface 40 of deck joist 14*a* so as to overlap the lower portion of that side surface 40. This first edge portion of water channeling member 12*a* may, however, be fixed to the exterior vertical side surface 42 of deck joist 14*a*, if desired. A small bead of waterproof caulking 46*a*, approximately the length of water channeling member 12*a*, is disposed on vertical side surface 40 along the contact surface between deck joist 14*a* and water channeling member 12*a* prior to affixing the edge portion of each water channeling member 12, thus creating a waterproof seal. Regardless of which vertical side surface 40 or 42 of deck joist 14*a* the edge portion is fixed, the opposite edge portion of the water channeling member 12*a* is affixed to the far vertical side surface 40 of adjacent deck joist 14*b*, straddling deck joist 14*b* and overlapping the lower portion of its vertical side surface.

As seen best in FIG. 2, when the second edge portion of water channeling member 12*a* is being installed against a side surface 40 an edge portion of the next water channeling member 12*b* is disposed over the second edge portion of water channeling member 12*a*, in an overlapping fashion, with its edge aligned parallel to and juxtaposed with the edge of water channeling member 12*a*. Thus, as seen in FIG. 2, the channeling member 12*a* and 12*b* sag so as to be respectively concaved along substantially their entire upper surfaces and convexed along substantially their entire lower surfaces while having linear increments along substantially their entire lengths. A small bead of waterproof caulking 46*b*, approximately the length of water channeling member 12*a*, is applied to the other edge portion of water channeling member 12*a* prior to positioning the first portion of channeling member 12*b* against it so that these edge portions overlap. This creates a waterproof seal.

The opposite edge portion of water channeling member 12*b* is then affixed to the opposite vertical side surface 40 of the next adjacent deck joist 14*c*, straddling the deck joist 14*c* and overlapping the lower portion of its vertical side surface 40. The preferred means for affixing or securing the water channeling members 12*a* and 12*b*, respectively, to the deck joists 14*a* and 14*b* is applying a series of detents, such as staples 19 or the equivalent to the overlapping edge portions and into the deck joist 14*a* or 14*b*, as the case may be spacing them substantially an equal distance apart, throughout the length of each deck joist 14. Then the overlapping and securing procedure, using successive water channeling members, is progressively repeated until a series of successive water channeling members 12 are suspended between all adjacent pair of said deck joists 14.

Figures 3A, 3B, 3C, 3D:
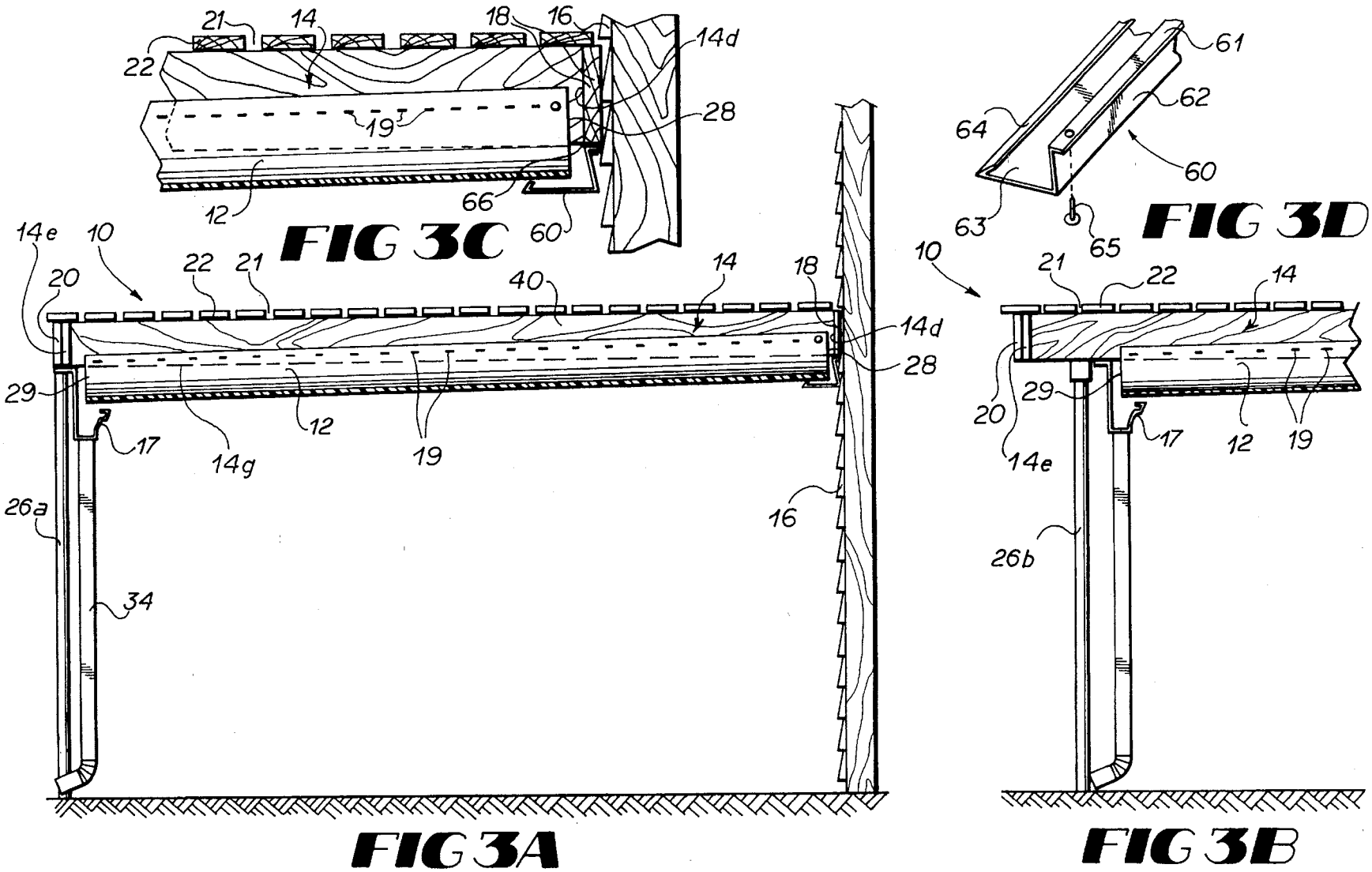
FIG. 3A is an partially broken away side elevational view of the deck and drainage system shown in FIG. 1.
FIG. 3B is a fragmentary side elevational view of a modified form of said deck drainage system of the deck shown in FIG. 1.
FIG. 3C is an enlarged fragmentary vertical sectional view of a portion of the deck structure of FIG. 1 showing the inner gutter attached to the house header thereof.
FIG. 3D is a fragmentary perspective view of the inner gutter illustrated in FIG. 3C.

Each individual water channeling member 12 is affixed to the deck joist 14 at an incline with respect to the deck joists 14 so that one series of adjacent ends 29 are lower than their other ends 28 to facilitate water flow away from the structure 16, as best illustrated in FIG. 3A. The seams on the outermost deck joists 14*a* and 14*c* created by fixing the water channeling members 12 to the vertical side surfaces 40 or 42 may be covered with trim molding 44 made of wood, aluminum or the equivalent as seen in FIG. 2.

FIG. 3B illustrates an alternative configuration of the first preferred embodiment. In FIG. 3B, the first preferred embodiment is installed on the raised deck 10 with recessed upright posts 26*b*. In this configuration, the water channeling members 12 will be cut to the appropriate length and installed in like manner. A gutter 17 may be attached to beneath all distal ends 29 of the scalloped configuration as illustrated in FIGS. 3A and 3B. The gutter 17 is a specially manufactured gutter with a high back to accommodate the scalloped water channeling members 12. Both FIG. 3A and 3B illustrate a downspout 34 which disposes of water collected in the gutter 17 in the normal way.

Figure 4:
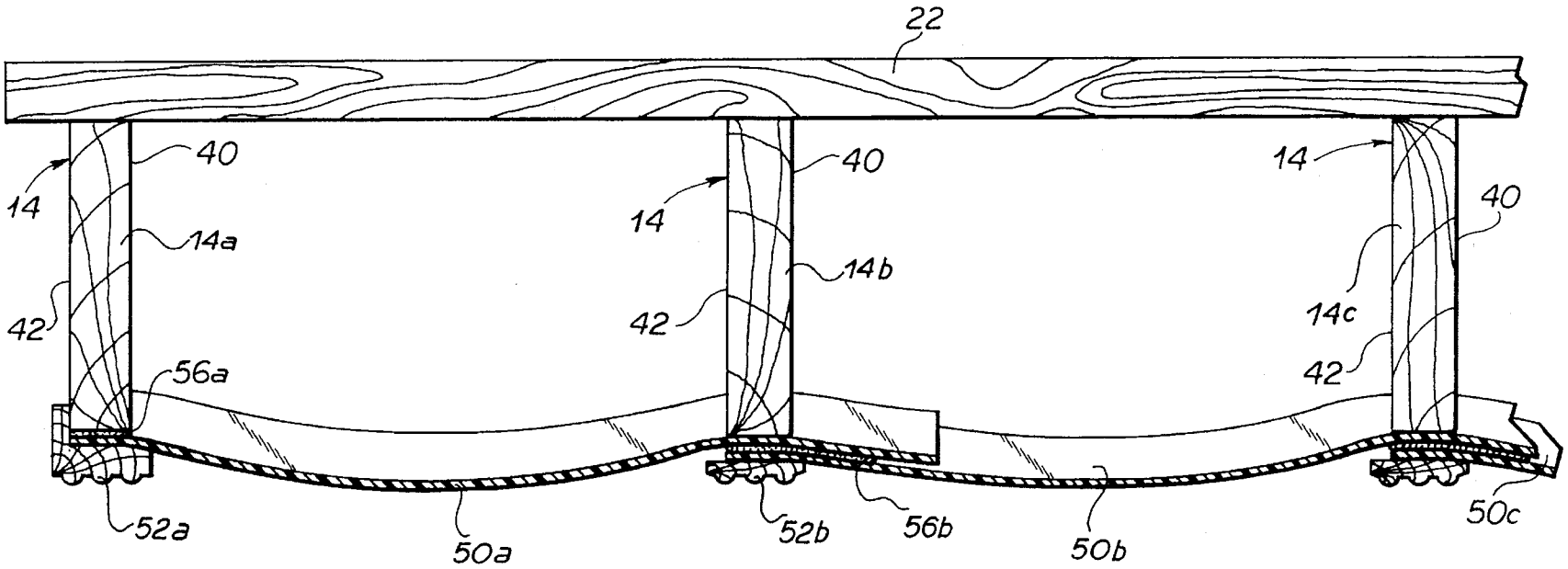
FIG. 4 is an enlarged fragmentary cross section of a portion of a second embodiment of the present invention showing the flat configuration of the deck drainage system.
Figure 5:
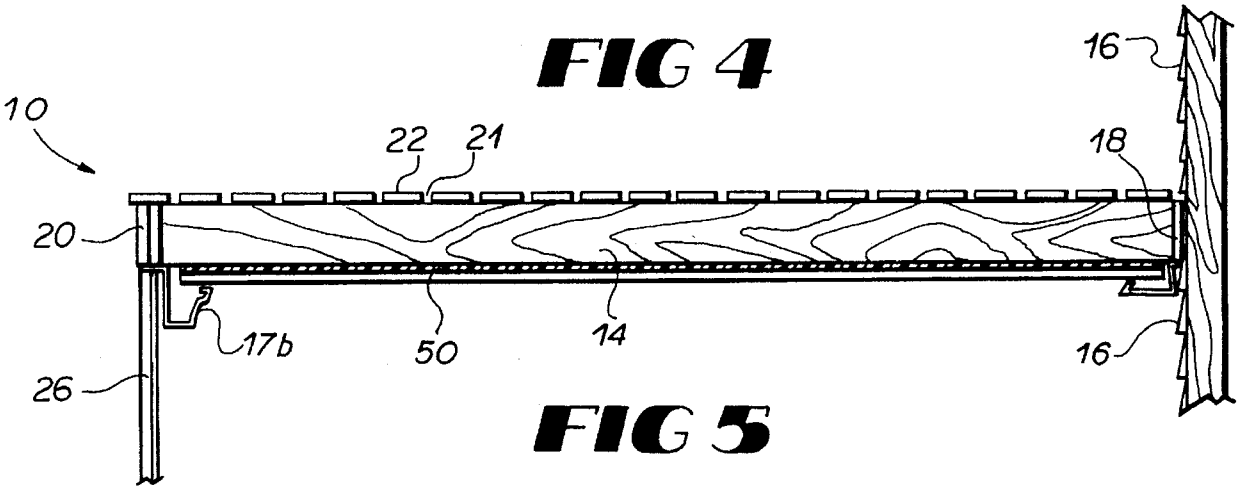
FIG. 5 is a fragmentary side elevational view of the second embodiment shown in FIG. 4 showing the flat configuration of this deck drainage system.

The second preferred embodiment known as the flat configuration utilizes the incline built into the patio decks 10 in accordance with local building codes, as illustrated in FIGS. 4 and 5. The incline of the deck 10 facilitates water flow away from the structure 16. The water channeling members 50*a*, 50*b*, 50*c* are fixed between adjacent deck joists 14*a*, 14*b*, 14*c* with edge portions overlapping at the bottom surface 14*g* of each individual deck joist 14*a*, 14*b*, 14*c*. When the water channeling members 50*a*, 50*b*, 50*c* are not wide enough to overlap adjacent water channeling members 50*a*, 50*b*, 50*c*, the water channeling members 50*a*, 50*b*, 50*c* are disposed contiguous and the edge portions of the water channeling members 50*a*, 50*b*, 50*c* are fixed to the bottom surface of the deck joists 14*a*, and 14*b*.

Installation of the flat configuration begins by fixing the edge portion of water channeling member 50*a* to the bottom surface of deck joist 14*a*, as illustrated in FIG. 4. This initial step is performed on an outermost deck joist 14*a* of the raised deck 10. A small bead of waterproof caulking 56*a*, approximately the length of water channeling member 50*a*, is disposed on the bottom surface 14*f* of deck joist 14*a*, thus creating a waterproof seal. Right angle trim molding 52*a* is then fixed to deck joist 14*a*, coveting the seam created by fixing the water channeling member 50*a* to deck joist 14*a*. The opposite edge portion of water channeling member 50*a* is disposed across the bottom surface of deck joist 14*b* where it is fixed so that water channeling member 50*a* is substantially horizontal with its body slightly concave as it is suspended between deck joist 14*a* and 14*b*.

The edge portion of the next water channeling member 50*b* is fixed to the bottom surface of deck joist 14*b* overlapping the edge portion of water channeling member 50*a* that overlapped deck joist 14*b*. Prior to fixing water channeling member 50*b*, a small bead of waterproof caulking 56*b* is disposed on water channeling member 50*a* where it will be overlapped by water channeling member 50*b*, thus creating a waterproof seal. Trim molding 52*b* is fixed over the seam created by water channeling members 50*a* and 50*b* at the bottom surface of deck joist 14*b*. The opposite edge of water channeling member 50*b* is fixed to the bottom surface of the next adjacent deck joist 14*c*. Then the overlapping and securing procedure using successive water channeling members is progressively repeated until a series of successive water channeling members 50*a*, 50*b*, 50*c*, etc. are mounted between each adjacent pair of said deck joists 14*a*, 14*b*, 14*c*, etc.

As a result, as best seen in FIG. 5, the drainage system, designated generally by numeral 50, is nearly flush to the underside of the raised deck 10. With this embodiment, the standard gutter 17*b* is utilized to collect water discharged from the ends of the water channeling members 50 and direct it to a downspout in FIG. 5.

If desired, the inner gutter 60, seen in FIGS. 3C and 3D may be provided for catching the water which may drain down between the house header 18 and the proximal end of all of the channeling members 12. In more detail, this inner gutter 60 is formed of a pliable material such as sheet metal which is bent in the shape illustrated in FIGS. 3C and 3D. This gutter 60 includes a rectangular upper mounting flange 61 which is mounted against the bottom surface of the house header 18 and is secured in place by means of nails, such as nail 65 or other fastening means. A layer of waterproof caulking 66 is disposed between the inner gutter 60 and the house header 18 creating a waterproof seal between the inner gutter 60 and house header 18, and the house header 18 and structure 16. A support flange 62 forms one edge of the mounting plate 61 and terminates in a lower edge about which the metal is bent so as to provide an outwardly extending horizontally disposed gutter bottom 63, the outer edge portion which is reversely bent to provide an upwardly inclined flange plate 64 which terminates below the proximal end portions of all water channeling members 12.

The material forming the gutter 60 is so bent as to form a Z-shaped cross section and consists of the flange 61, the panel 62 and the bottom 63. The purpose of the Z-shape is to bias the common edge between the member 62 and 63 against the wall 16 of the structure.

When installing the gutter 60, the gutter is deformed forwardly so as to enable the nails such as nail 65 to be mounted into place securing the plate 61 to the head of. The bottom 63 of the gutter 60 is disposed essentially horizontally, therefore any accumulation of water in the cross portion of the gutter will eventually drain to one side or the other of the gutter, thereby discharging the water on one side or the other of the raised deck 10.

It will be obvious to those skilled in the art that many variations may be made to the embodiment here chosen for the purpose of illustrating the present invention without departing from the scope thereof as defined in the appended claims.

I claim:

1. A deck drainage system for mounting between adjacent joists of a deck assembly, said joists having lower portions comprising a plurality of water channeling members respectively formed from a substantially flexible web material and having side edges and distal and proximal ends, said water channeling members being substantially identical to each other and of essentially uniform width, length, and thickness, said water channeling members being arranged side-by-side in succession and having said side edges of adjacent of said water channeling members mounted to the lower portion of said joists in overlapping relationship, with said water channeling members being concaved along their upper surfaces and convexed along their lower surfaces, said concaved and convexed surfaces extending between adjacent deck joists; said joists having adjacent opposed vertical side surfaces and said side edges of each of said water channeling members being secured to the respective vertical sides surfaces of two adjacent deck joists to incline said water channeling members and thereby direct collected water toward the ends of said water channeling members; and including a high back gutter disposed adjacent to said distal ends of said water channeling members for collecting the water directed toward said ends and for covering said distal ends of said water channeling members.

2. A deck drainage system for mounting between adjacent joists of a deck assembly said joists having lower portions comprising a plurality of water channeling members respectively formed from a substantially flexible web material and having side edges and distal and proximal ends, said water channeling members being substantially identical to each other and of essentially uniform width, length, and thickness, said water channeling members being arranged side-by-side in succession and having said side edges of adjacent of said water channeling members mounted to the lower portion of said joists in overlapping relationship with said water channeling members being concaved along their upper surfaces and convexed along their lower surfaces, said concaved and convexed surfaces extending between adjacent deck joists; said joists have bottom portions and said overlapping side edges of said water channeling members being disposed against successive of said bottom portions of adjacent deck joists.

3. The deck drainage system defined in claim 2 including exposed fasteners securing said side edges to said joists and trim molding for covering said overlapping side edges of said water channeling members and said exposed fasteners.

4. The deck drainage system defined in claim 2 including a high back gutter disposed adjacent to said distal ends of said water channeling members for collecting the water directed toward said distal ends.

5. The deck drainage system defined in claim 2 including recessed upright posts supporting said deck.

6. The deck drainage system defined in claim 2 including an inner gutter disposed adjacent to said proximal ends of said water channeling members for collecting water.

7. A deck assembly having a plurality of substantially parallel, equally spaced deck joists and a plurality of paralled equally spaced cross pieces disposed transversely over said deck joists, said deck joists having upper and lower portions with opposite vertical side surfaces and parallel top and bottom surfaces, said cross pieces having side edges spaced from each other for defining openings therebetween through which water will pass by gravity, wherein the improvement comprises:

a plurality of water channeling members, each being formed of a flexible web material, said channeling members being of approximately the same length and width, said channeling members each having opposed edge portions respectively adjacent to said side surfaces of adjacent deck joists, said channeling members having central portions and distal and proximal ends, said channeling members being sufficiently wide that the central portions of said channeling members are suspended successively between adjacent deck joists to form abutting individual troughs which collect the water passing between said cross pieces for directing the collected water in said channeling members in directions parallel to said deck joists toward the ends of said water channeling members, and spaced fastening means for securing said edge portions of said channeling members to lower portions of said joists; said fastening means secure said abutting edge portions against said side surfaces of said deck joists; said edge portions of adjacent of said water channeling members being overlapped and said fastening means passing through the overlapped edge portions; said deck joists having outer and inner vertical side surfaces parallel to each other and said overlapped edge portions being disposed against successive outer vertical side surfaces of said deck joists.

8. A deck assembly having a plurality of substantially parallel, equally spaced deck joists and a plurality of parallel equally spaced cross pieces disposed transversely over said deck joists, said deck joists having upper and lower portions with opposite vertical side surfaces and parallel top and bottom surfaces, said cross pieces having side edges spaced from each other for defining openings therebetween through which water will pass by gravity, wherein the improvement comprises:

a plurality of water channeling members, each being formed of a flexible web material, said channeling members being of approximately the same length and width, said channeling members each having opposed edge portions respectively adjacent to said side surfaces of adjacent deck joists, said channeling members having central portions and distal and proximal ends, said channeling members being sufficiently wide that the central portions of said channeling members are suspended successively between adjacent deck joists to form abutting individual troughs which collect the water passing between said cross pieces for directing the collected water in said channeling members in directions paralled to said deck joists toward the ends of said water channeling members, and spaced fastening means for securing said edge portions of said channeling members to lower portion of said joists; said abutting edge portions of said water channeling members being disposed against successive of said bottom surfaces of said deck joists.

9. The deck assembly defined in claim 8 including trim moldings for covering said abutting edge portions and exposed said fastening means.

10. A process of installing a deck drainage system onto a deck assembly of the type having longitudinally extending, uniformly spaced successive joists which support spaced cross pieces which form a flooring of said deck, each said joists having opposed vertical side surfaces, the spaces between said cross pieces permitting water to fall therebetween, comprising the steps of:

(a) producing a plurality of substantially identical rectangular water channeling members of flexible material, each having opposed side edge portions and being of a width greater than a distance between the centerline of said adjacent deck joists;

(b) securing one of said side portions of a first of said water channeling members to one of said vertical side surfaces of an outermost deck joist of said deck assembly;

(c) arranging another of said water channeling members so that one of said edge portions overlaps said edge portion of said first of said water channeling members;

(d) securing the overlapped said edge portions to said vertical side surface which is farthest from said outermost desk joist of a deck joist adjacent to said outermost deck joist; and (e) progressively repeating the overlapping and securing procedures using successive water channeling members and thereby producing a series of successive overlapping water channeling members which are suspended between successive adjacent pairs of said deck joists.

11. The process defined in claim 10 wherein said water channeling members have opposite ends and are inclined in one direction to provide a series of said ends which are lower than other of said ends, and disposing a gutter transversely across said series of said ends of said channeling members and directing the water received by said gutter in a common direction away from said water channeling members.

12. The process defined in claim 10 including the step of disposing a second gutter beneath said other ends of said water channeling members.

13. A process of installing a deck drainage system onto a deck assembly of the type having longitudinally extending, uniformly spaced successive joists which support spaced cross pieces which form a flooring of said deck, each said joist having opposed vertical side surfaces, the spaces between said cross pieces permitting water to fall therebetween, comprising the steps of:

producing a plurality of substantially identical rectangular water channeling members of flexible material, each having opposed side edge portions and being of a width greater than a distance between the centerline of said adjacent deck joists;

(b) securing one of said side portions of a first of said water channeling members to one of said vertical side surfaces of an outermost deck joist of said deck assembly;

(c) arranging another of said water channeling members so that one of said edge portions overlaps said edge portion of said first of said water channeling members;

(d) securing the overlapped said edge portions to said vertical side surface which is furthest from said outermost deck joist of a deck joist adjacent to said outermost deck joist;

(e) progressively repeating the overlapping and securing procedures using successive water channeling members and thereby producing a series of successive overlapping water channeling members which are suspended between successive adjacent pairs of said deck joists; and (f) applying caulking between said overlapped edge portions of said water channeling members.

14. A process of installing a deck drainage system onto a deck assembly of the type having longitudinally extending, uniformly spaced successive joists which support spaced cross pieces which form a flooring of said deck, each said joist having opposed vertical side surfaces, the spaces between said cross pieces permitting water to fall therebetween, comprising the steps of:

(a) producing a plurality of substantially identical rectangular water channeling members of flexible material, each having opposed side edge portions and being of a width greater than a distance between the centerline of said adjacent deck joists;

(b) securing one of said side portions of a first of said water channeling members to one of said vertical side surfaces of an outermost deck joist of said deck assembly;

(c) arranging another of said water channeling members so that one of said edge portions overlaps said edge portion of said first of said water channeling members;

(d) securing the overlapped said edge portions to said vertical side surface which is farthest from said outermost deck joist of a deck joist adjacent to said outermost deck joist;

(e) progressively repeating the overlapping and securing procedures using successive water channeling members and thereby producing a series of successive overlapping water channeling members which are suspended between successive adjacent pairs of said deck joists;

(f) said water channeling members having opposite ends and being inclined in one direction to provide a series of said ends which are lower than other of said ends, disposing a gutter transversely across said series of said ends of said channeling members and directing the water received by said gutter in a common direction away from said water channeling members; and (g) applying caulking between said gutter and the deck.

* * * * *